US008826894B1

(12) United States Patent
Darlington et al.

(10) Patent No.: US 8,826,894 B1
(45) Date of Patent: Sep. 9, 2014

(54) COMPOUND ARCHERY BOW

(75) Inventors: Rex F. Darlington, Whittemore, MI (US); David P. McNeil, II, Howard City, MI (US)

(73) Assignee: Rex Darlington, Hale, MI (US)

( * ) Notice: Subject to any disclaimer, the term of this patent is extended or adjusted under 35 U.S.C. 154(b) by 467 days.

(21) Appl. No.: 13/212,797

(22) Filed: Aug. 18, 2011

(51) Int. Cl.
*F41B 5/10* (2006.01)

(52) U.S. Cl.
CPC ..... *F41B 5/105* (2013.01); *Y10S 124/90* (2013.01)
USPC ..... 124/25.6; 124/25; 124/86; 124/900

(58) Field of Classification Search
CPC ..... F41B 5/105; Y10S 124/90
USPC ..... 124/23.1, 25, 25.6, 900; 12/23.1, 25, 12/25.6, 86, 900
See application file for complete search history.

(56) References Cited

U.S. PATENT DOCUMENTS

| | | | | |
|---|---|---|---|---|
| 4,300,521 | A * | 11/1981 | Schmitt | 124/25.6 |
| 4,461,267 | A * | 7/1984 | Simonds et al. | 124/25.6 |
| 4,993,399 | A * | 2/1991 | Chattin | 124/25.6 |
| 5,390,655 | A * | 2/1995 | Mitchell et al. | 124/25.6 |
| 5,687,703 | A * | 11/1997 | Vyprachticky | 124/25.6 |
| 6,076,512 | A * | 6/2000 | Thielen et al. | 124/25.6 |
| 6,237,582 | B1 * | 5/2001 | McPherson | 124/25.6 |
| 6,776,148 | B1 * | 8/2004 | Islas | 124/25.6 |
| 6,792,931 | B1 * | 9/2004 | Schaar | 124/25.6 |
| 6,990,970 | B1 * | 1/2006 | Darlington | 124/25.6 |
| 7,441,555 | B1 * | 10/2008 | Larson | 124/25.6 |
| 7,946,281 | B2 * | 5/2011 | Miller | 124/25.6 |
| 8,037,876 | B1 * | 10/2011 | Yehle | 124/25.6 |
| 8,220,446 | B2 * | 7/2012 | Batdorf | 124/25.6 |
| 8,276,574 | B1 * | 10/2012 | Wilson | 124/25.6 |
| 8,443,791 | B2 * | 5/2013 | Miller | 124/25.6 |
| 8,651,095 | B2 * | 2/2014 | Islas | 124/25 |
| 2007/0193568 | A1 * | 8/2007 | Lee | 124/25.6 |
| 2009/0288650 | A1 * | 11/2009 | Batdorf | 124/25.6 |
| 2010/0051005 | A1 * | 3/2010 | Wilson | 124/25.6 |
| 2010/0089375 | A1 * | 4/2010 | McPherson et al. | 124/25.6 |
| 2010/0132682 | A1 * | 6/2010 | Darlington | 124/25.6 |
| 2010/0252013 | A1 * | 10/2010 | Miller | 124/25.6 |

OTHER PUBLICATIONS

Photos of a "Ross Carnivore" Bow Marketed by Bow Tech (Extreme Technologies Inc.).

* cited by examiner

*Primary Examiner* — Gene Kim
*Assistant Examiner* — Alexander Niconovich
(74) *Attorney, Agent, or Firm* — Reising Ethington PC

(57) ABSTRACT

A compound archery bow includes a bow handle having projection limbs, and first and second pulleys mounted on the limbs for rotation around on axles. A bow cable arrangement includes a bowstring cable extending from a bowstring anchor through a bowstring let-out groove at the first pulley and then toward the second pulley, a first cable extending from a first anchor through a portion of a groove on the first pulley and then toward the second pulley, and a second cable extending from a second anchor through a portion of a groove on the first pulley and then toward the second pulley. The first cable includes a yoke having a first end connected to the first anchor, a split second end connected to the first axle on opposite sides of the first pulley, and a third end extending toward the second pulley. The yoke preferably includes an idler pulley mounted on a bracket. The first cable preferably extends around the idle pulley between the first and second ends, and the third end extends from the bracket toward the second pulley. The second pulley and the bow cable arrangement at the second pulley, including the yoke, preferably are near mirror images of each other at the first and second pulleys.

16 Claims, 11 Drawing Sheets

FIGURE 1A
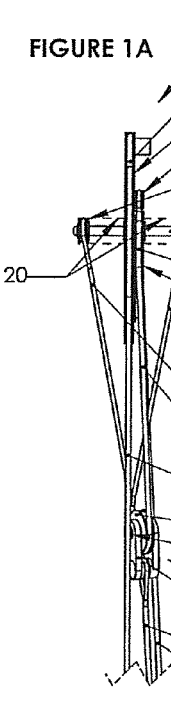
FIGURE 1C
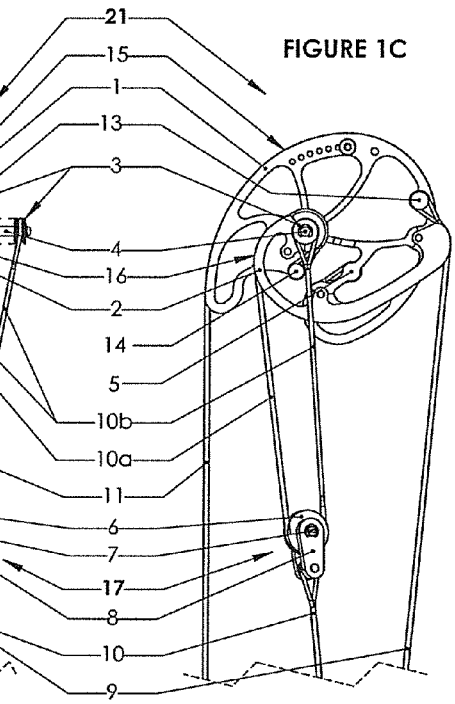
FIGURE 2A
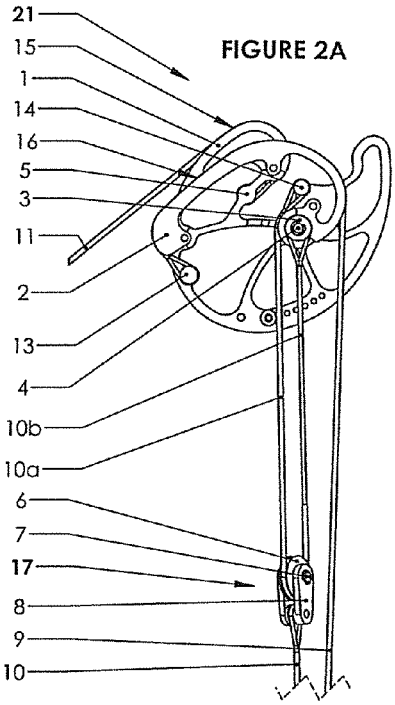
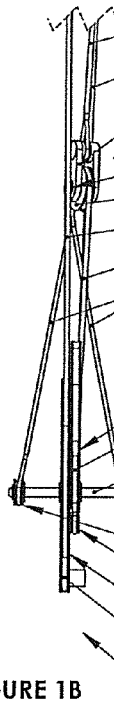
FIGURE 1B
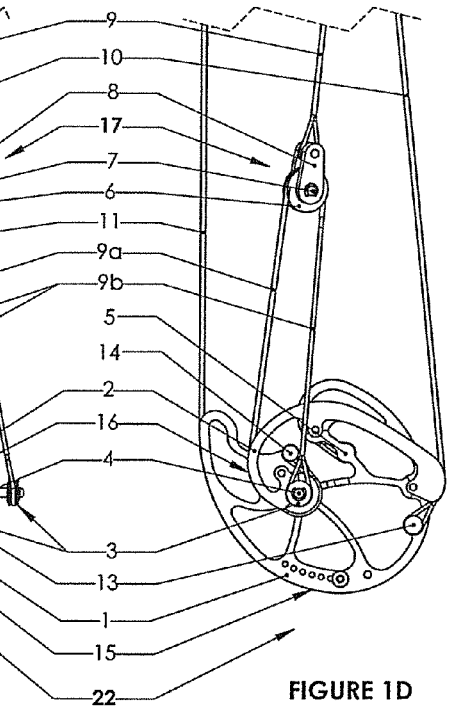
FIGURE 1D
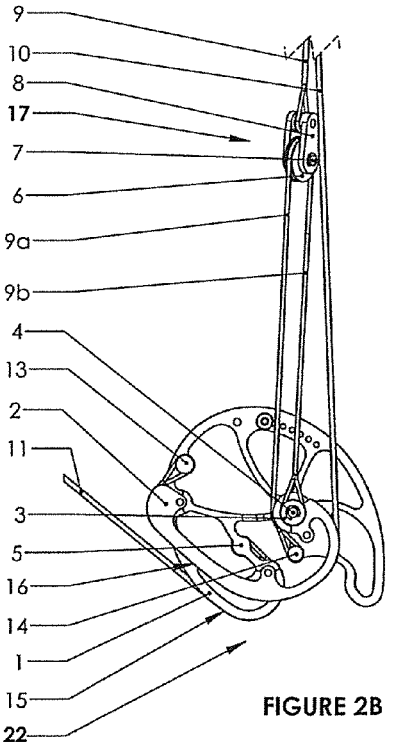
FIGURE 2B FIGURE 3A
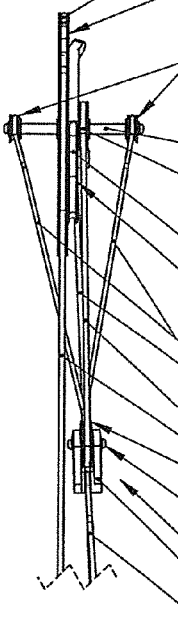
FIGURE 3C
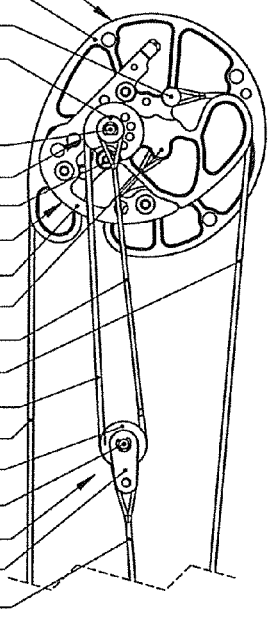
FIGURE 4A
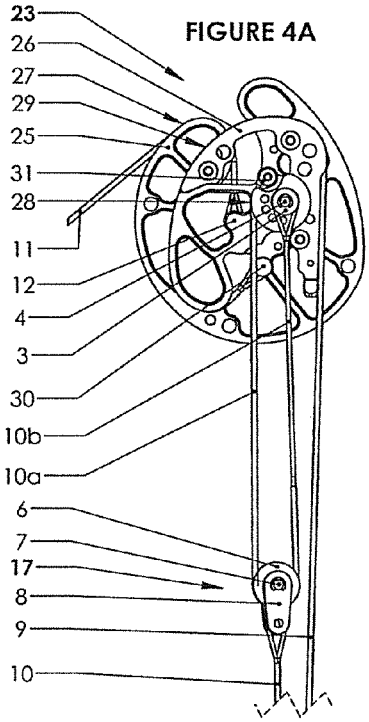
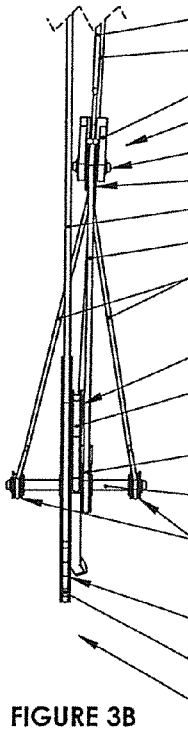
FIGURE 3B
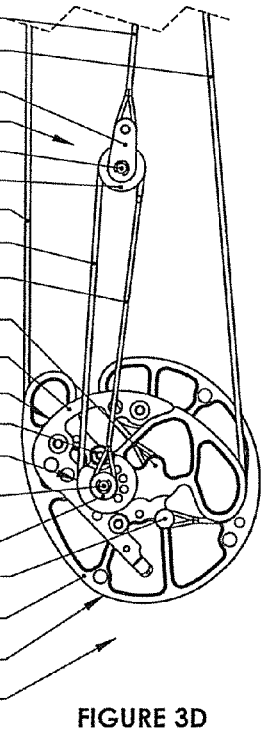
FIGURE 3D
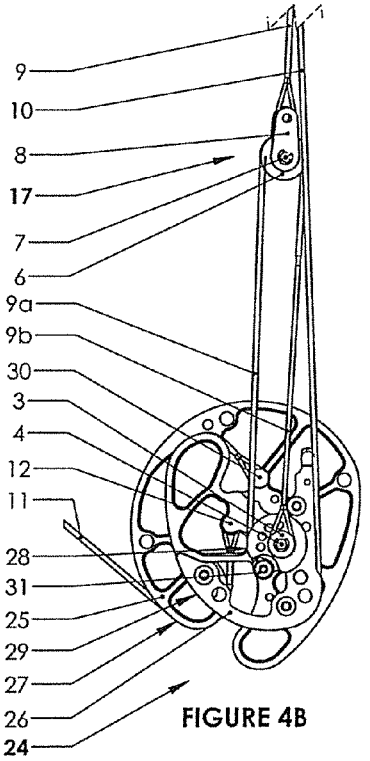
FIGURE 4B FIGURE 5A
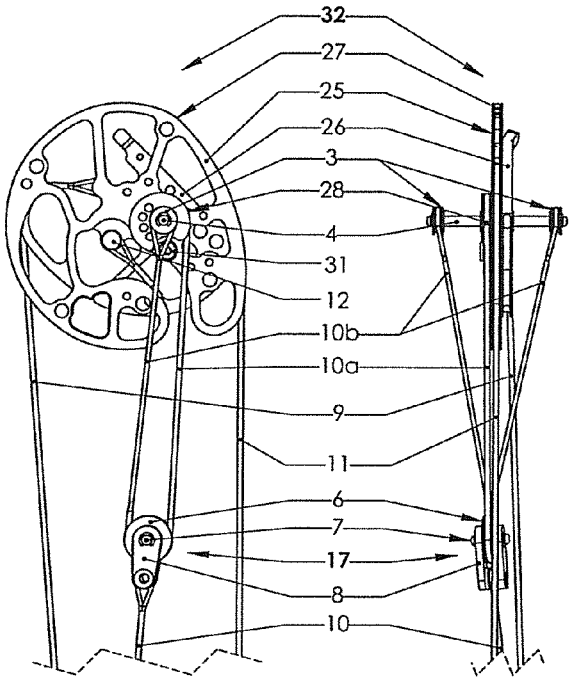
FIGURE 5C
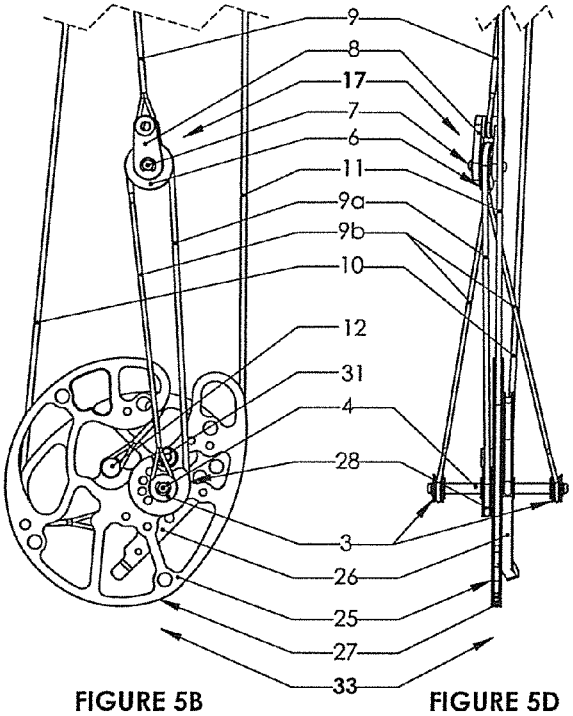
FIGURE 5B
FIGURE 5D
FIGURE 6A
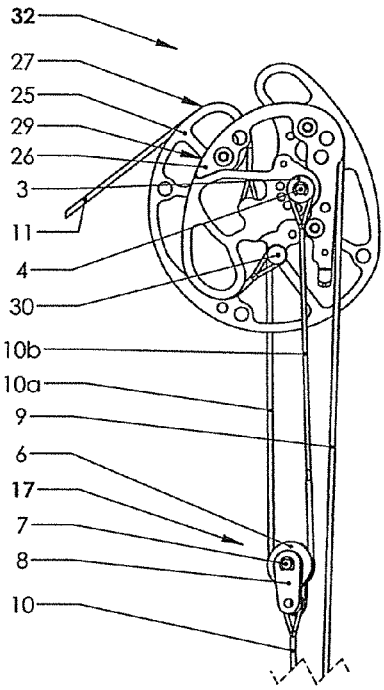
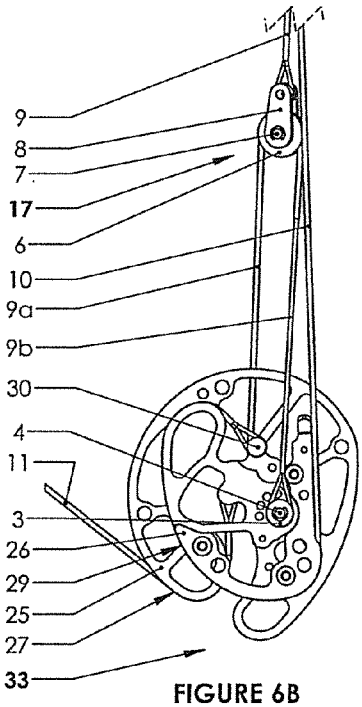
FIGURE 6B 34
15
1
16
4
2
3
13
14
5
36b
36a
37
17
6
7
8
11
36
37
11
8
7
6
17
36
37a
37b
5
14
13
3
2
4
16
1
15
35

FIGURE 8A
FIGURE 8C
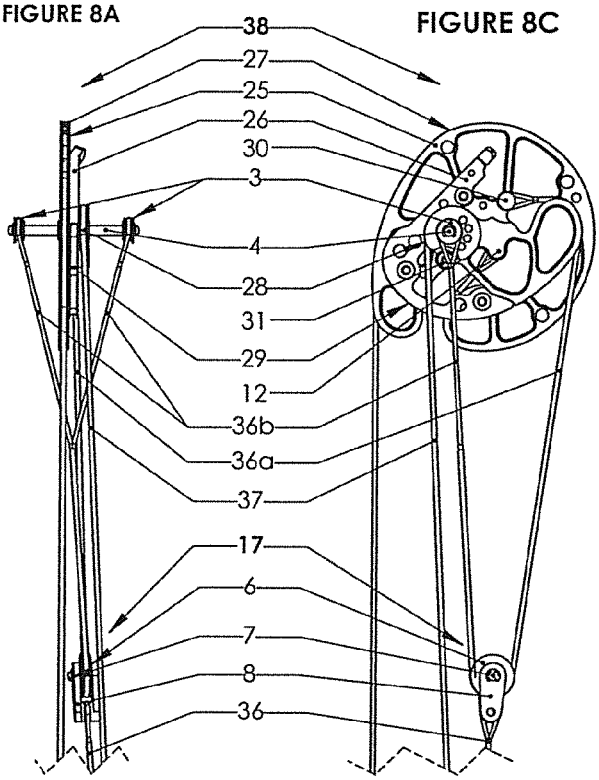
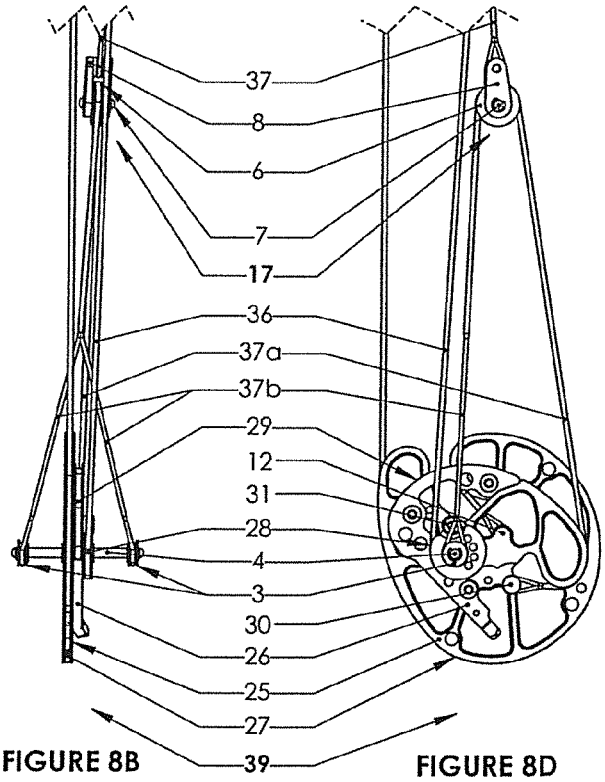
FIGURE 8B
FIGURE 8D

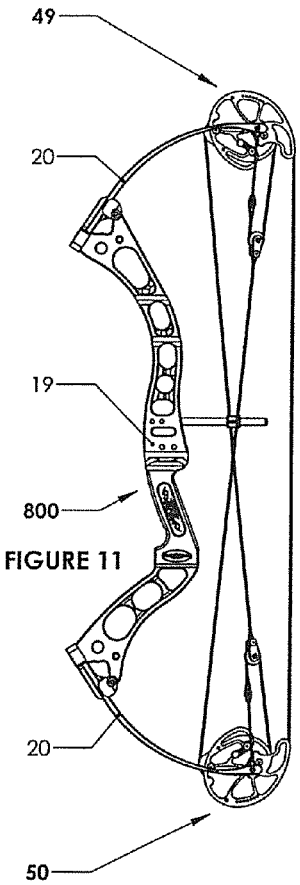
FIGURE 11
FIGURE 11A
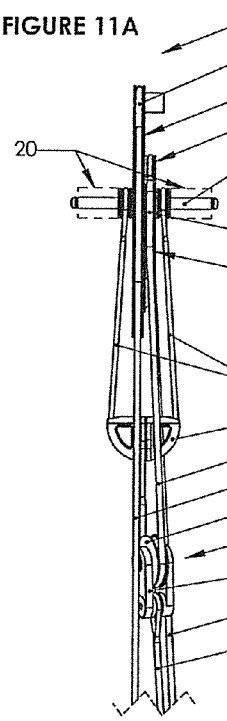
FIGURE 11C
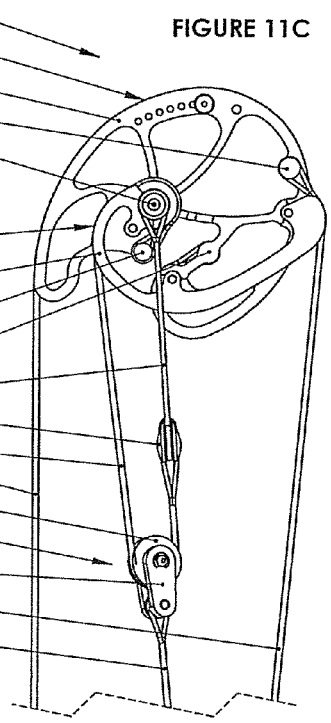
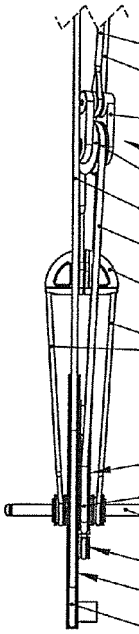
FIGURE 11B
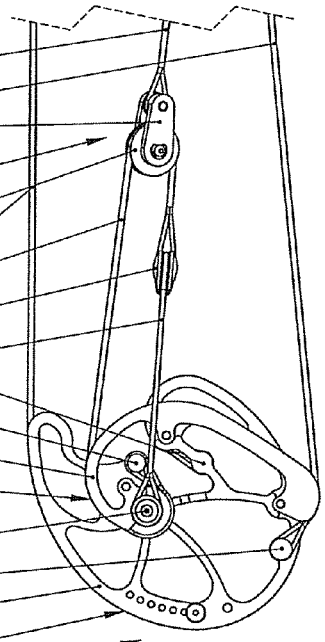
FIGURE 11D 51
20
19
900
52
15
1
13
4
16
2
14
5
53a
53b
11
6
17
8
10
9

COMPOUND ARCHERY BOW

The present disclosure relates to compound archery bows, including crossbows, having pulleys at the ends of the bow limbs to control the force/draw characteristics of the bow, and more particularly to an improvement in bows of this type to reduce the torque and friction applied to the pulley axles as the bow is drawn and released.

BACKGROUND AND SUMMARY OF THE DISCLOSURE

Single-cam and dual-cam compound archery bows have a power cam mounted on one or both ends of the bow limbs to control the draw force on the bowstring and bending of the limbs as the bowstring is drawn. A general object of the present disclosure is to provide a compound archery bow of the described type in which performance is improved by reducing friction and torque applied to the pulley(s).

The present disclosure embodies a number of aspects that can be implemented separately from or in combination with each other.

A compound archery bow, in accordance with one aspect of the present disclosure, includes a bow handle having projection limbs, and first and second pulleys mounted on the limbs for rotation on respective axles. A bow cable arrangement includes a bowstring cable extending from a bowstring anchor through a bowstring let-out groove at the first pulley and then toward the second pulley, a first cable extending from a first anchor through a portion of a groove on the first pulley and then toward the second pulley, and a second cable extending from a second anchor through a portion of a groove on the first pulley and then toward the second pulley. The first cable includes a yoke having a first end connected to the first anchor, a split second end connected to the first axle on opposite sides of the first pulley, and a third end extending toward the second pulley. The yoke preferably includes an idler pulley mounted on a bracket. The first cable preferably extends around the idle pulley between the first and second ends, and the third end extends from the bracket toward the second pulley. The first and second pulleys, and the bow cable arrangement at the pulleys, including the yokes, preferably are near mirror images of each other.

A compound archery bow, in accordance with another aspect of the present disclosure, includes a bow handle having projecting limbs, with at least a first of the limbs having a split end. First and second pulleys are mounted on the limbs for rotation on respective axles, with the first pulley being mounted on its associated axle within the split end of the first limb. A bow cable arrangement includes a bowstring cable extending from a bowstring anchor through a bowstring let-out groove at the pulley and then toward the second pulley. A first cable extending from a first anchor through a portion of a groove on the first pulley and then toward the second pulley, and a second cable extending from a second anchor through a portion of a groove on the first pulley and then toward the second pulley. The first cable includes a yoke having a first end connected to the first anchor, a second end anchored at the first axle within the split end of the first limb, and a third end extending toward the second pulley. The yoke preferably includes an idler pulley mounted on a bracket. The first cable preferably extends around the idler pulley between the first and second ends, and the third end extends from the bracket toward the second pulley. The first and second pulleys, and the bow cable arrangement at the pulleys, including the yokes, preferably are near mirror images of each other.

BRIEF DESCRIPTION OF THE DRAWINGS

The disclosure, together with additional objects, features, advantages and aspects thereof, will best be understood from the following description, the appended claims and the accompanying drawings, in which:

FIGS. 1A and 1B together comprise end elevational views of the pulleys and bow cable arrangement in the bow in FIG. 1;

FIGS. 1C and 1D together comprise side elevational views of the pulley and bow cable system in FIG. 1 viewed from the side opposite FIG. 1;

FIGS. 2A and 2B together comprise a side elevational view of the pulleys and bow cable arrangement in the bow of FIG. 2;

FIGS. 3A and 3B together comprise an end elevational view of the cam and cable system in the bow of FIG. 3;

FIGS. 3C and 3D together comprise a side elevational view of the pulley and cable system in the bow of FIG. 3 viewed from the opposite side as compared with FIG. 3;

FIGS. 4A and 4B together comprise side elevational views of the pulley and cable system of the bow in FIG. 4;

FIGS. 5A and 5B together comprise a side elevational view of the pulleys and cable system in the bow of FIG. 5 at its rest or undrawn condition;

FIGS. 5C and 5D together comprise an end elevational view of the pulley and cable arrangement in the bow of FIG. 5;

FIGS. 6A and 6B together comprise a side elevational view of the pulley and cable arrangement in FIG. 5 in the fully drawn condition of FIG. 6;

FIGS. 8A and 8B together comprise an end elevational view of the bow pulley and cable arrangement in FIG. 8;

FIGS. 8C and 8D together comprise a side elevational view of the bow pulley and cable arrangement in the bow of FIG. 8 as viewed from the opposite side of FIG. 8;

FIG. 11 is a side elevational view of a compound archery bow in accordance with a further exemplary embodiment of the present disclosure;

FIGS. 11A and 11B together comprise an end elevational view of the bow pulley and cable arrangement in FIG. 11;

FIGS. 11C and 11D together comprise a side elevational view of the bow pulley and cable arrangement in the bow of FIG. 11 as viewed from the opposite side of FIG. 11;

DETAILED DESCRIPTION OF PREFERRED EMBODIMENTS

Figure 1:
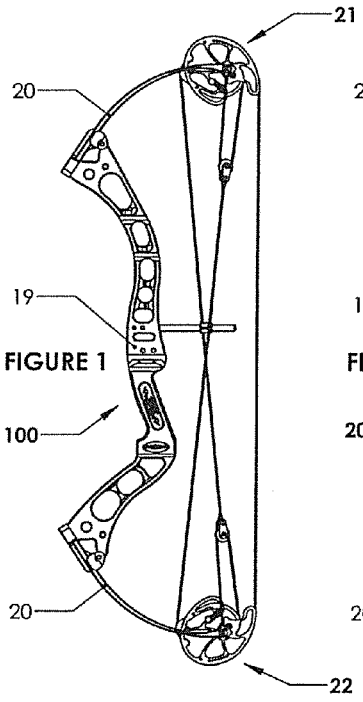
FIG. 1 is a side elevational view of a compound archery bow in accordance with a first exemplary embodiment of the present disclosure in its rest or undrawn condition.
Figure 2:
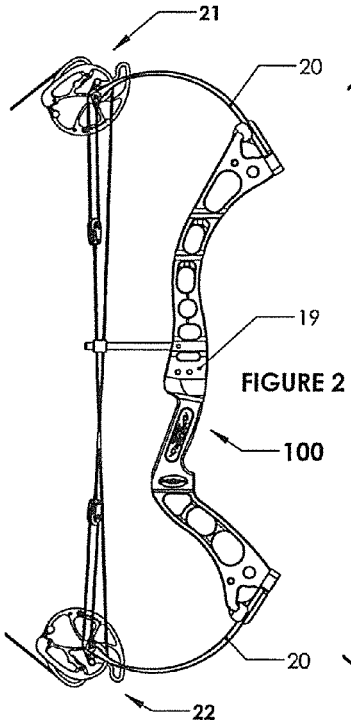
FIG. 2 is a side elevational view of the bow in FIGS. 1-1D in the fully drawn condition.

FIGS. 1-1D illustrate a compound archery bow 100 in accordance with a first exemplary embodiment of the present disclosure in its rest or undrawn position, while FIGS. 2-2B illustrate the same bow 100 in its fully drawn condition. Bow 100 includes a handle 19 of aluminum or other relatively rigid construction having spaced risers with limb-mounting surfaces at each end. A pair of flexible resilient limbs 20 of fiber-reinforced or other suitable resilient construction are mounted on their respective handle risers and project away from handle 19. An upper pulley 21 is mounted on upper limb 20 for rotation on an axle 4, and a lower pulley 22 is mounted on an end of lower limb 20 for rotation on an axle 4. The axles can be integral with the pulleys and rotatable in bearings on the limbs, or can be separate from the pulleys and the pulleys rotatable on the axles. Bow 100 is a dual-cam bow in which pulleys 21, 22 are similar in function and preferably near mirror images of each other. (Upper pulley 21 can be slightly larger than lower pulley 22 to compensate for the arrow rest not being at the true center of the bow. The pulleys also can be made non-identical in areas that are non-functional to create a difference in appearance.)

Bow 100 has a bow cable system or arrangement that includes a bowstring cable 11 extending from an anchor 5 at pulley 21 around a peripheral let-out groove 15 (FIG. 1A) across handle 19, around a peripheral let-out groove 15 at pulley 22 and then to an anchor 5 at pulley 22. (The terms "let-out" and "take-up" are used in their conventional senses to refer to grooves that "let-out" cable or "take-up" cable as the bowstring is drawn away from the bow handle.) A pair of cables 9, 10 extend between pulleys 21, 22 to control rotation at their respective pulleys as bowstring 11 is drawn. In the exemplary embodiment of FIGS. 1-2B, cable 9 extends from an anchor 13 through a portion of a groove 16 and then toward pulley 22. Approaching pulley 22, cable 9 attaches to a yoke pulley assembly 17, of which one end 9*a* extends through a portion of a groove 16 at pulley 22 and then to an anchor 14. The other end 9*b* is coupled to axle 4, preferably split on opposing sides of axle 4 as best seen in FIG. 1B. The cable connection at yoke pulley assembly 17 preferably includes an idler pulley 6 rotatably mounted on a bracket 8. Cable 9*a* is trained around pulley 6 before being split at ends 9*b*. Cable 9 is anchored to bracket 8.

Cable 10 likewise extends from an anchor 13 at pulley 22 through a portion of groove 16 at pulley 22 and then attaches to yoke pulley assembly 17 with a cable end 10*a* extending through a groove portion 16 to an anchor 14. The other end 10*b* of the yoke at cable 10 is split and coupled to axle 4 on opposite sides of pulley 21 as best seen in FIG. 1B. Yoke pulley assemblies 17 preferably are identical, each comprising an idler pulley 6 rotatably mounted on a bracket 8. Again, cable portion 10*a* and split portions 10*b* are trained around pulley 6 while cable 10 extends from bracket 8 to anchor 13 at pulley 22. Pulleys 21, 22 and cables 9, 10, including yoke pulley assemblies 17 and split ends 9*a*, 9*b* and 10*a*, 10*b*, preferably are near mirror images of each other.

As bowstring 11 is drawn away from handle 19 in the embodiment of FIGS. 1-2B, bowstring 11 is let out from bowstring let-out grooves 15 at their respective pulleys. This causes rotation of the respective pulleys on their axles. Cable end 10*a* is let out from groove 16 at pulley 21 while cable end 9*a* is let out from groove 16 at pulley 22. Cable 9 is taken up into groove 16 at pulley 21 and cable 10 is taken up into groove 16 at pulley 22. Thus, in this embodiment, cable is simultaneously let out from and taken up into different portions of grooves 16 at the respective pulleys. In the meantime, yoke pulley assembly 17 on cables 9, 10 apply a reduced load to the pulley bearings by anchoring the split yoke cable directly to the axle on opposite sides of the pulley, reducing friction and torque at the bearing systems and improving performance. The limbs are more stable and resistant to torque because some of the cable load is distributed to the axles outboard of the pulleys. By placing the yoke cable anchors outboard of the limbs, the slots at the ends of the limbs to accommodate the pulleys can be reduced in size. When using two individual limb sections (as distinguished from a single split limb) at each end of the bow, the limb sections can be placed closer together.

Figure 3:
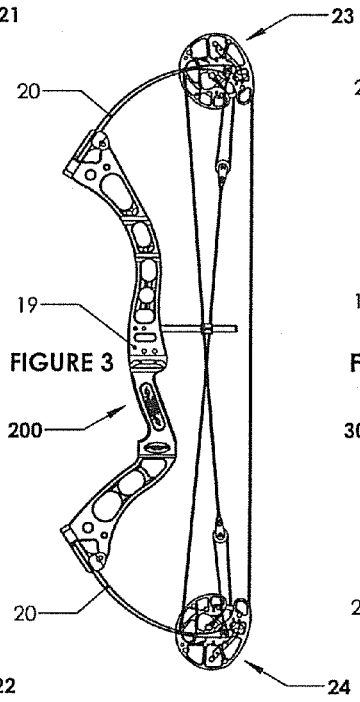
FIG. 3 is a side elevational view of a compound archery bow in accordance with a second exemplary embodiment of the present disclosure in its rest or undrawn condition.
Figure 4:
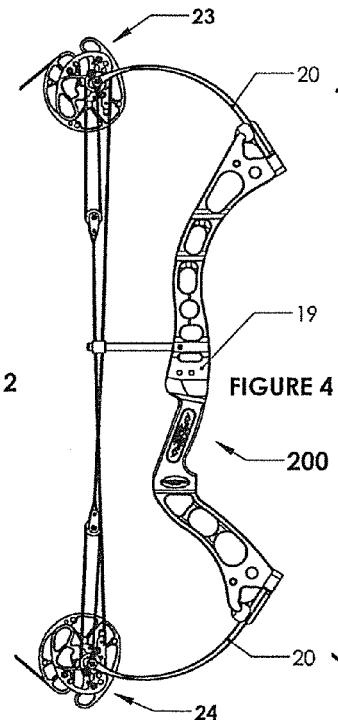
FIG. 4 is a side elevational view of the bow in FIG. 3 in its fully drawn condition.

FIGS. 1-2B illustrate an exemplary embodiment of the present disclosure having two grooves at each pulley as disclosed in US 2010/0051005 (the disclosure of which is incorporated herein by reference) and with the yoke pulley assemblies 17 in the cable let-out system of the pulleys. FIGS. 3-4B illustrate a second exemplary dual-cam bow 200, this time with three grooves at each pulley as generally disclosed in U.S. Pat. No. 6,990,970B1 (the disclosure of which is incorporated herein by reference), and with the yokes again in the cable let-out portions of the cable system. Reference numerals in FIGS. 3-4B (and in FIGS. 5-13E) that are identical to reference numerals employed in FIGS. 1-2B indicate correspondingly identical or related components. In bow 200 of FIGS. 3-4B, the let-out grooves 28 for cable portions 9*a*, 10*a* are separate from the take-up grooves 29 for cable portions 9, 10. Bowstring cable 11 in FIGS. 5-6B again extends from an anchor 12 at upper pulley 32 around a peripheral bowstring let-out groove 27, then across the bow handle to the bowstring let-out groove 27 on pulley 33 and then to an anchor 12 at pulley 33. Cable 9 extends from an anchor 30 (FIG. 6A) through a portion of take-up groove 29 to yoke pulley assembly 17, and then at 9*b* to the opposite ends of axle 4 and at 9*a* to let-out groove 28 at pulley 33. Likewise, cable 10 extends from a take-up groove 29 on pulley 33 to yoke pulley assembly 17, and then at end 10*a* to let-out groove 28 and split ends 10*b* to the opposite ends of axle 4 at pulley 32. As bowstring cable 11 is drawn away from handle 19 in the embodiment of FIGS. 3-4B, cables 9, 10 are taken up into grooves 29 and cable ends 9*a*, 10*a* are let out from grooves 28. Again, split cable sections 9*b*, 10*b* help balance the forces applied to the respective axles 4 and the forces applied to the bow limbs.

Figure 5:
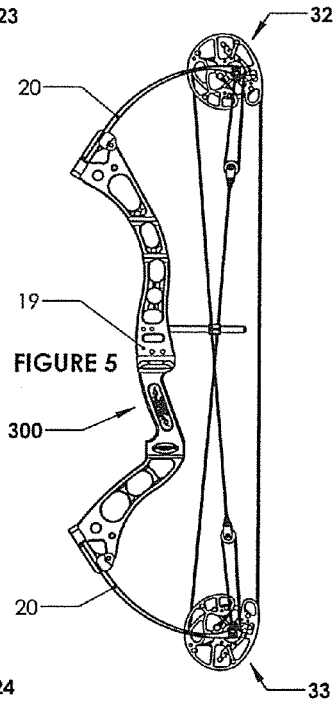
FIG. 5 is a side elevation view of a compound archery bow in accordance with a third exemplary embodiment of the present disclosure.
Figure 6:
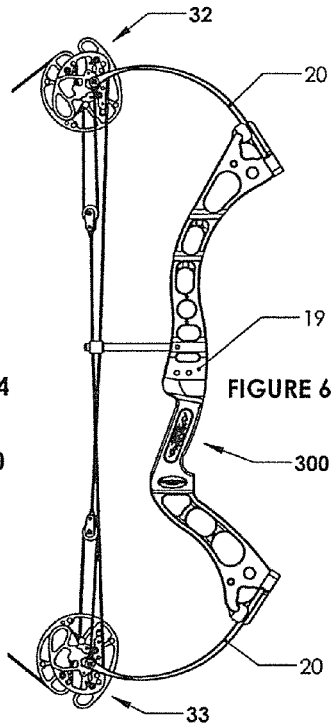
FIG. 6 is a side elevational view of the bow in FIG. 5 in its fully drawn condition.

FIGS. 5-6B illustrate a bow 300 that is similar in many respects to bow 200 of FIGS. 3-4B. The primary differences between bow 200 and bow 300 are that the take-up grooves 29 and the let-out grooves 28 are on opposite sides of the bowstring let-out groove 27 on pulleys 32 and 33.

Figure 7:
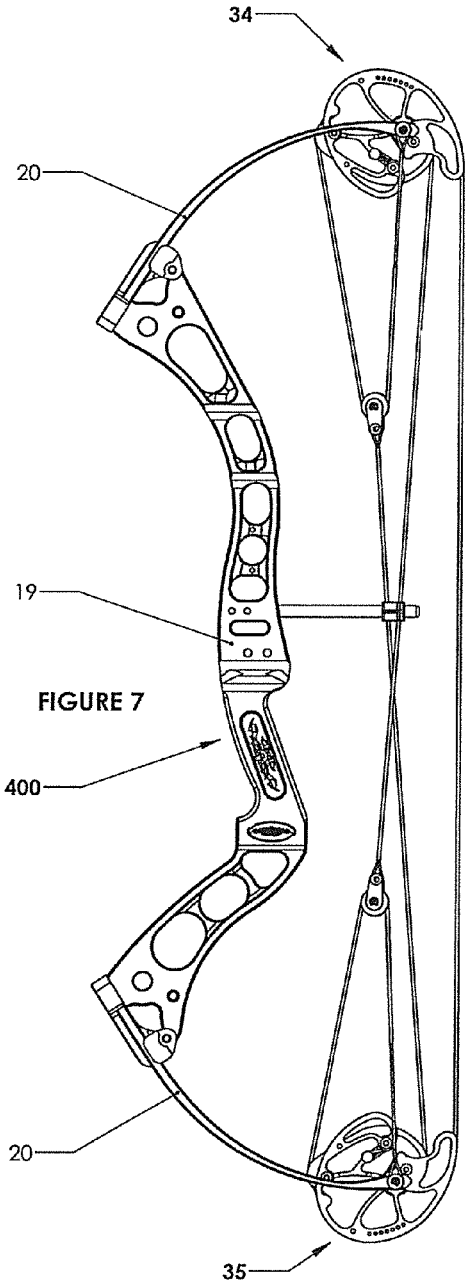
FIG. 7 is a side elevational view of a modification to the bow of FIG. 1.
Figure 8:
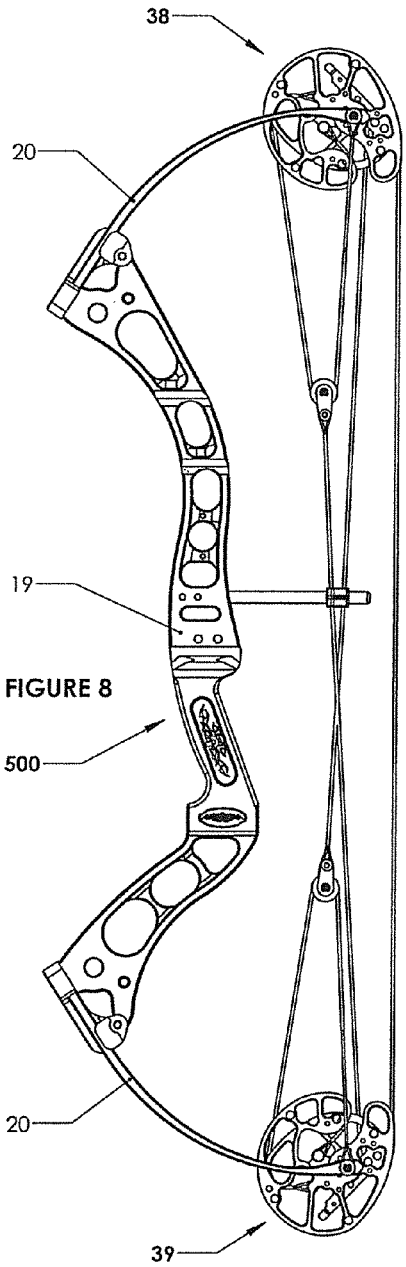
FIG. 8 is a side elevational view of a modification to the bow of FIG. 3.
Figures 7A, 7B, 7C, 7D:
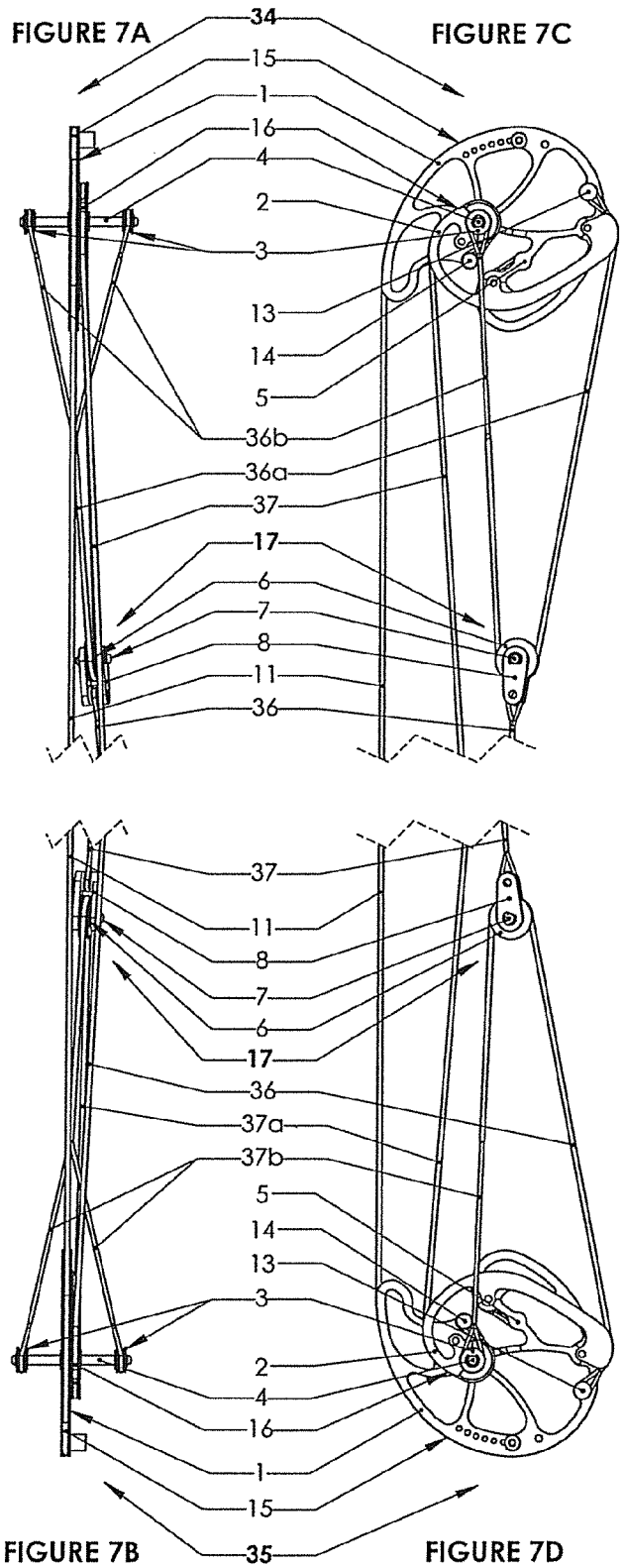
FIGS. 7A-7B together comprise an end elevational view of the bow pulleys and cable arrangement in FIG. 7.
FIGS. 7C and 7D together comprise a side elevational view of the pulley and cable arrangement in the bow of FIG. 7 as viewed from the opposite side as compared with FIG. 7.

FIGS. 7-7D illustrate a bow 400 that is similar in many respects to bow 100 of FIGS. 1-2B. The primary difference between bow 400 and bow 100 is that the yoke pulley assemblies 17 in bow 400 are in the take-up paths of cables 36, 37 at pulleys 34, 35 rather than in the let-out paths of the respective cables 8, 9 in bow 100. Likewise, FIGS. 8-8D illustrate a bow 500 that is similar in many respects to bow 200 in FIGS. 3-4B except that yoke pulley assemblies 17 are in the take-up portions of cables 36, 37 at pulleys 38, 39 of bow 500 rather than in the let-out portions of cables 9, in bow 200.

Figure 9:
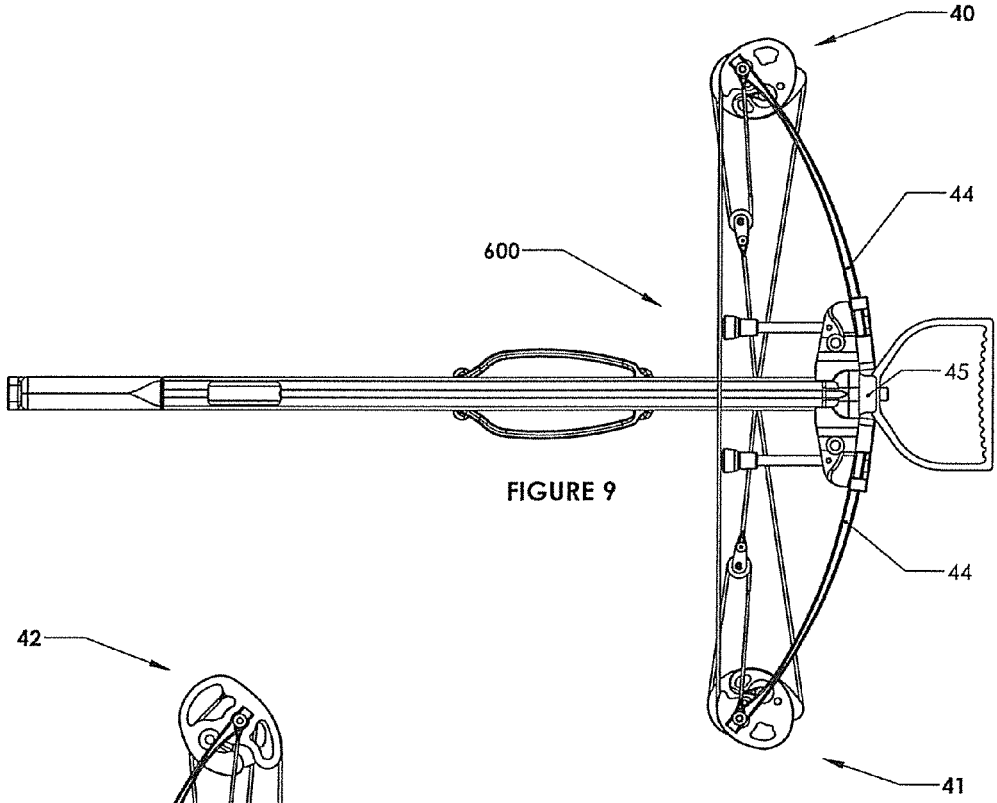
FIGS. 9 and 10 are elevational views of crossbows in accordance with respective further exemplary embodiments of the disclosure.
Figure 10:
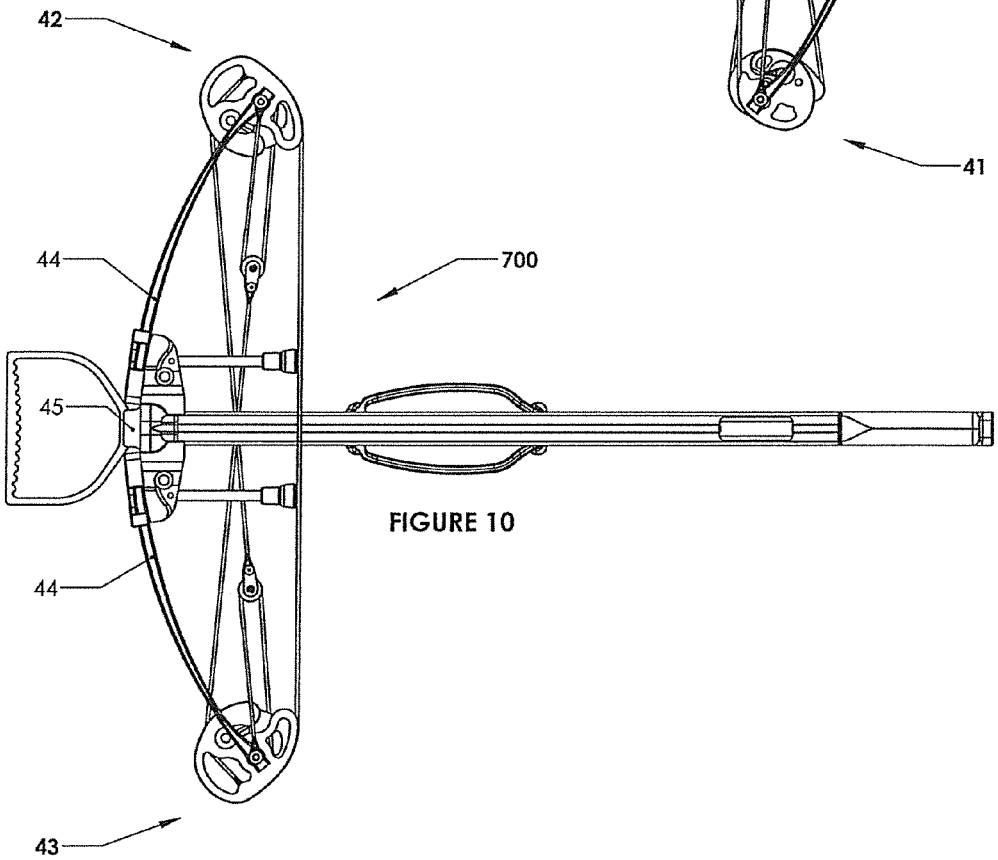

FIGS. 9 and 10 illustrate respective crossbows 600 and 700 in accordance with additional exemplary embodiments of the disclosure. In each crossbow, flexible resilient limbs 44 are mounted on opposed ends of a handle riser 45. Pulleys are rotatably mounted on the ends of the limbs, pulleys 40, 41 in FIG. 9 and pulleys 42, 43 in FIG. 10. The bow cable arrangement in FIG. 9, including the yokes, is generally similar to that described in detail above in connection with FIGS. 1-2B, and the bow cable arrangement in FIG. 10 is generally similar to that described in detail above in connection with FIGS. 5-6B.

In the bow 800 of FIGS. 11-11D, the bow limbs 20 are split, and the pulleys 49, 50, including the cable anchors at axles 4, are disposed between the split sections of the limbs 20 at the ends of the limbs. At upper pulley 49, cable 10 is split at yoke pulley assembly 17, with a first portion 47 extending through a portion of groove 16 to anchor 14 and a second portion extending from yoke pulley assembly 17 to a cable spreader 46. End cable portions 48 extend from spreader 46 to anchor at axle 4 on opposite sides of pulley 49. The cable arrangement at lower pulley 50 is the mirror image of the system at upper pulley 49, with cable section 47 extending through a portion of groove 16 to anchor 14, and the opposite ends 48 extending from spreader 46 to anchor at axle 4 on opposite sides of pulley 50. The cable spreaders 46 allow the cables to clear the respective pulleys when anchored between the pulleys and portions of the limbs 20 lying outboard of the pulleys as shown in FIG. 11A (as distinguished from being outboard of the limbs as illustrated at 20 in FIG. 1A) and simplifies construction of the yoke cables. The cable spreader arrangement of FIGS. 11-11D could be employed in any of the embodiments of FIGS. 1-10.

Figures 12, 12A, 12B, 12C, 12D:
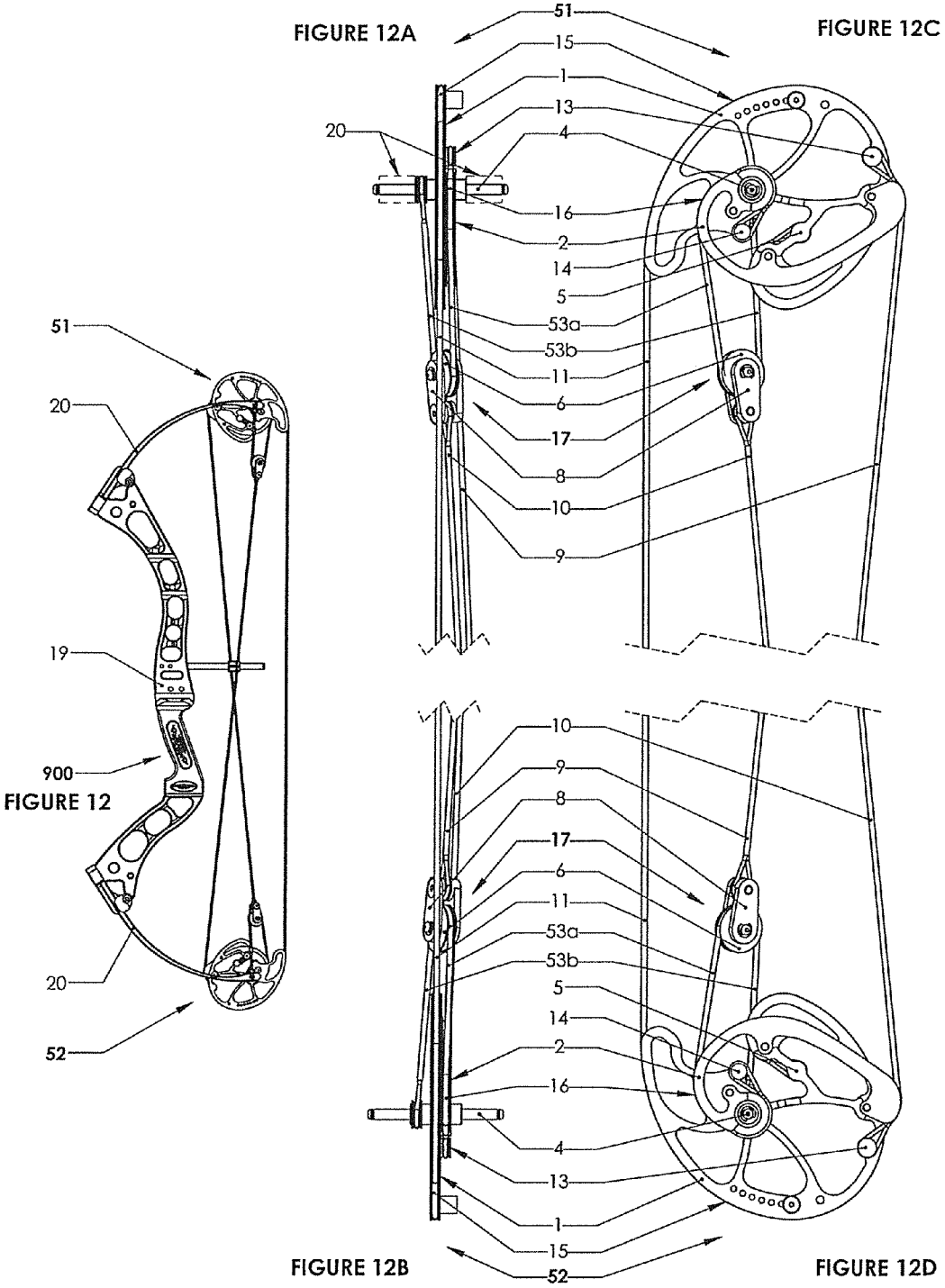
FIG. 12 is a side elevational view of a compound archery bow in accordance with yet another exemplary embodiment of the present disclosure.
FIGS. 12A and 12B together comprise an end elevational view of the bow pulley and cable arrangement in FIG. 12.
FIGS. 12C and 12D together comprise a side elevational view of the bow pulley and cable arrangement in the bow of FIG. 12 as viewed from the opposite side.

In the bow 900 of FIGS. 12-12D, the bow limbs 20 again are split, and the pulleys 51, 52, including the cable anchors at axles 4, are disposed between the split sections of the limbs 20 at the ends of the limbs. (Reference to "split" limbs includes both solid limbs having a notch at the ends in which the pulleys and axles are disposed, and limbs that are divided from handle 19 outward with the limbs and anchors being disposed between the divided sections of the limbs adjacent to the outer ends of the limbs.) Cable end 53*a* extends through a portion of groove 16 to anchor 14 on pulley 51, and end 53*b* extends to and is anchored at axle 4. The cable connections at the other end of the bow are a mirror image of the cable connections at the upper end of the bow. Thus, the primary differences between the bow 900 in FIGS. 12-12D and the bow 100 of FIGS. 1-1D are that cable ends 53*a* in FIGS. 12-12D are not split as are cable ends 10*b* in FIGS. 1-1D, and that cable ends 53 in FIGS. 12-12D are anchored to axles 4 within the bow limb split ends 20 rather than outboard of the bow limb split ends 20 as in FIGS. 1-1D. This feature is particularly useful in crossbow applications.

Figures 13, 13A, 13B, 13C, 13D, 13E:
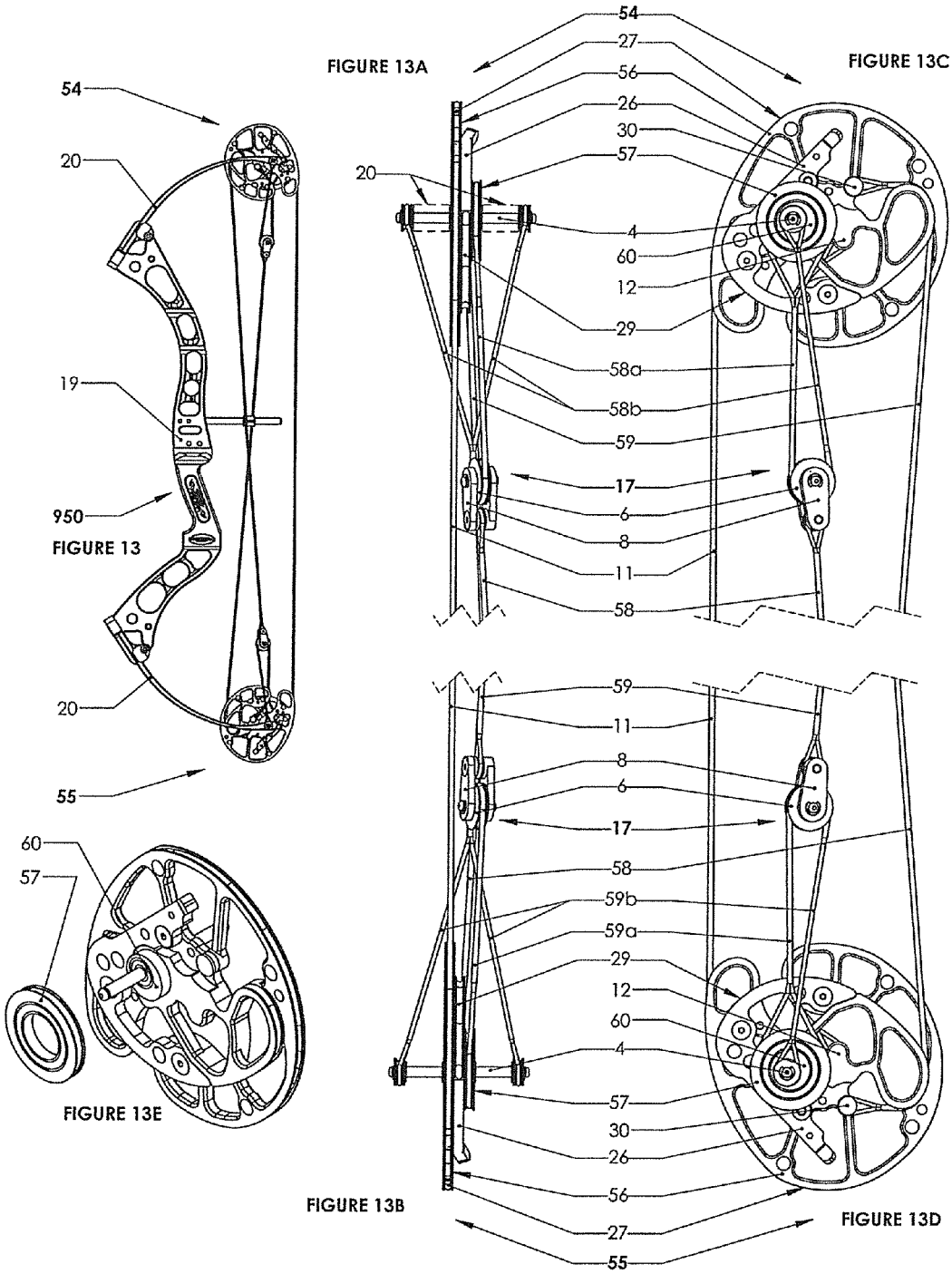
FIG. 13 is a side elevational view of a compound archery bow in accordance with yet another exemplary embodiment of the present disclosure.
FIGS. 13A and 13B together comprise an end elevational view of the bow pulley and cable arrangement in FIG. 12.
FIGS. 13C and 13D together comprise a side elevational view of the bow pulley and cable arrangement in the bow of FIG. 12 as viewed from the opposite side.
FIG. 13E is an exploded perspective view of the upper pulley in the embodiment of FIGS. 13A to 13D.

In the bow 950 of FIGS. 13-13E, The cable ends 58*b*, 59*b* are split and anchored at axe's 4 as in several previous embodiments, while the cable ends 58*a*, 59*a* encircle annular idlers 57 at each pulley. Each idler 57 is mounted on an associated boss 60, which is mounted on the associated pulley surrounding and eccentric to the axis the associated axle 4. This arrangement effectively moves the centers of the concentric idlers 57 to feed-out and take-up cables 58, 59 as the bow is drawn.

There thus has been disclosed a compound archery bow that fully satisfies all of the objects and aims previously set forth. The bow has been disclosed in conjunction with several exemplary embodiments, and modifications and variations have been discussed. Other modifications and variations readily will suggest themselves to persons of ordinary skill in the art in view of the foregoing description. The disclosure is intended to embrace these and all other modifications are variations as fall within the spirit and broad scope of the appended claims.

The invention claimed is:

1. A compound archery bow that includes:

projecting limbs, a first pulley mounted on a first of said limbs for rotation on a first axle, a second pulley mounted on a second of said limbs for rotation on a second axle, and a bow cable arrangement including a bowstring cable extending from a bowstring anchor through a bowstring let-out groove at said first pulley and then toward said second pulley, a first cable extending from a first anchor through a portion of a groove on said first pulley and then toward said second pulley, and a second cable extending from a second anchor through a portion of a groove on said first pulley and then toward said second pulley, characterized in that said first cable includes a yoke having a first end connected to said first anchor, a split second end anchored at said first axle on opposite sides of said first pulley, and a third end extending toward said second pulley, and said second pulley and said bow cable arrangement at said second pulley, including said yoke, are near mirror images of each other, wherein said first cable extends from a let-out groove in said first pulley and said second cable extends from a take-up groove on said first pulley and said first cable and said second cable are simultaneously let out from and taken up into the same groove of said first pulley.

2. The bow set forth in claim 1 wherein said yoke includes a bracket and an idler pulley on said bracket, said first cable extending around said idler pulley between said first and second ends, said third end of said first cable extending from said bracket toward said second pulley.

3. The bow set forth in claim 1 wherein said bow is a crossbow.

4. The bow set forth in claim 1, wherein said first anchor includes an annular idler on a boss eccentric to an axis of the first axle, and said first end of said first cable is connected to said annular idler.

5. A compound archery bow that includes:

projecting first and second limbs, a first pulley mounted on a first of said limbs for rotation on a first axle and a second pulley mounted on a second of said limbs for rotation on a second axle, and a bow cable arrangement including a bowstring cable extending from a bowstring anchor at said first pulley through a bowstring let-out groove at said first pulley across said handle and then through a bowstring let-out groove at said second pulley to a bowstring anchor at said second pulley, a first cable extending from a first anchor at said first pulley through a portion of a groove on said first pulley and then across said handle to a first yoke, said first cable having a first portion extending from said yoke through a portion of a groove on said second pulley and to an anchor at said second pulley, and a split second portion extending from said first yoke to anchor at said second axle on opposite sides of said second pulley, and a second cable extending from a second anchor on said second pulley through a portion of a groove on said second pulley and then toward said first pulley across said handle, said second cable including a second yoke from which a first end extends through a portion of a groove on said first pulley to a second anchor at said first pulley and a split second portion extending from said second yoke to anchor at said first axle on opposite sides of said first pulley, wherein said first cable extends from a take-up groove on said first pulley and a let-out groove on said second pulley, said second cable extends from a let-out groove on said first pulley and a take-up groove on said second pulley and said split second portion of said first cable is anchored within end portions of said first limb and said split second portion of said second cable is anchored within end portions of said second limb.

6. The bow set forth in claim 5 wherein said first and second pulleys and said bow cable arrangement at said first and second pulleys, including said yokes, are near mirror images of each other.

7. The bow set forth in claim 6 wherein each of said yokes includes a bracket and an idler pulley on said bracket.

8. The bow set forth in claim 7 wherein said second portions of said first and second cables include respective cable spreaders, and wherein said split portions of said first and second cables anchor to said axles on opposite sides of said pulleys between said pulleys and portions of said limbs lying outboard of said pulleys.

9. A compound archery bow that includes:

projecting limbs, at least a first of said limbs having a split end, a first pulley mounted on said first of said limbs for rotation on a first axle within said split end, a second pulley mounted on a second of said limbs for rotation on a second axle, and a bow cable arrangement including a bowstring cable extending from a bowstring anchor through a bowstring let-out groove at said first pulley and then toward said second pulley, a first cable extending from a first anchor through a portion of a groove on said first pulley and then toward said second pulley, and a second cable extending from a second anchor through a portion of a groove on said first pulley and then toward said second pulley, characterized in that said first cable includes a yoke having a first end connected to said first anchor, a second end anchored at said first axle within said split end of said first limb, and a third end extending toward said second pulley, wherein said first cable extends from a let-out groove in said first pulley and said second cable extends from a take-up groove on said first pulley and said split second end of said first cable is anchored at said first axle on opposite sides of said first pulley within said split end of said first limb.

10. The bow set forth in claim 9 wherein said yoke includes a bracket and an idler pulley on said bracket, said first cable extending around said idler pulley between said first and second ends, said third end of said first cable extending from said bracket toward said second pulley.

11. The bow set forth in claim 10 wherein said second pulley and said bow cable arrangement at said second pulley, including said yoke, are near mirror images of each other.

12. The bow set forth in claim 10 wherein said bow is a crossbow.

13. A compound archery bow that includes:

first and second limbs;

a first pulley mounted on a first of said limbs for rotation around a first axis;

a second pulley mounted on a second of said limbs for rotation around a second axis;

a first cable extending from bowstring let-out means on said first and second pulleys;

a second cable extending from a take-up means on said first pulley and toward said second pulley, and connecting to a first idler pulley mounting bracket having a third axis;

a third cable anchoring at one end to said second pulley, extending through a let-out means of said second pulley, extending around a first idler pulley, and splitting into split portions connecting to opposite sides of said second pulley;

a fourth cable extending from a take-up means on said second pulley and toward said first pulley, and connecting to a second idler pulley mounting bracket having a fourth axis; and a fifth cable anchoring at one end to said first pulley and through a let-out means, extending around a second idler pulley, and splitting into split portions connecting to opposite sides of said first pulley.

14. The bow set forth in claim 13 wherein said split portions of said third and fifth cables are anchored, respectively, on opposite sides of the first and second pulleys within end portions of said limbs.

15. The bow set forth in claim 13 wherein said first cable and said second cable are simultaneously let out from and taken up into the same means of said first pulley, and said fourth cable and said fifth cable are simultaneously let out from and taken up into the same means of said second pulley.

16. The bow set forth in claim 13 wherein said bow is a crossbow.

* * * * *